United States Patent [19]

Pan

[11] 4,152,794

[45] May 8, 1979

[54] AUTOMATIC PRESSURE FLUSH-TOILET OF DELAYING DRAINAGE

[76] Inventor: Tien H. Pan, 5th Fl., No. 175-9, Kuo Ching, Taipei Hsien, Taiwan

[21] Appl. No.: 744,139

[22] Filed: Nov. 22, 1976

[51] Int. Cl.[2] ..... E03D 11/00; E03D 13/00; E03D 1/06

[52] U.S. Cl. ..... 4/432; 4/433; 4/302; 4/369

[58] Field of Search ..... 4/100, 77, 76, 89, 90, 4/9-10, 8, 79

[56] References Cited

U.S. PATENT DOCUMENTS

| | | | |
|---|---|---|---|
| 1,650,370 | 11/1927 | Mahoney | 4/77 |
| 1,777,108 | 9/1930 | Schiller | 4/78 |
| 3,184,761 | 5/1965 | Broughton | 4/90 |
| 3,228,036 | 1/1966 | Zaske et al. | 4/77 |
| 3,648,297 | 3/1972 | MacMillan | 4/73 |
| 3,673,614 | 7/1972 | Claunch | 4/10 |
| 3,713,177 | 1/1973 | Tufts et al. | 4/77 X |
| 3,829,909 | 8/1974 | Rod et al. | 4/10 |
| 3,934,275 | 1/1976 | Bishton, Jr. | 4/10 |

*Primary Examiner*—Henry K. Artis
*Attorney, Agent, or Firm*—Holman & Stern

[57] ABSTRACT

This invention discloses an improvement in the flush-toilet at which the water will flush out automatically into the basin at the period of time after somebody uses it. By means of two pumps installed at different levels and a connector to contain a magnet, a lever will be controlled to activate another pump to jet air into a water tank. This action opens a water conduit in the tank and the water is permitted to flush into the basin. Also the compressed air in the water tank presses strongly the water to flow into the conduit. The time in delaying the drainage of water to flush into the basin depends on the speed of the magnet moving in the connector, and the length and the inclination of that connector. The magnet is drawn upward in the connector when the lower pump is activated by the weight of somebody upon the seating circle. After the utilizer leaves the flush-toilet, the magnet moves back to its primary location to attract a lever. Then, the stopper of a conduit is opened and the water is flushed into the basin.

4 Claims, 7 Drawing Figures

AUTOMATIC PRESSURE FLUSH-TOILET OF DELAYING DRAINAGE

BRIEF SUMMARY OF THE INVENTION

The flush-toilet is a necessity in the daily life. The conventional type comprises a handle or a pedal for starting the water to flush into the basin. This is a inconvenient process to the utilizer. Additionally, the water tank of conventional flush-toilet has an opening communicating with the atmosphere, so that the strength of flushed water is limited.

This invention relates to an improvement to the shortcomings described above. First of all, a mechanism is involved in the new designed flush-toilet that will enable automatically the water tank to permit the water to flush into the basin at a short period of time after the flush-toilet is utilized. Second, the improved water tank of this invention encloses compressed air in it, so the strength of flushed water is enhanced so that better efficiency in washing the flush-toilet can be obtained.

The main structure of this invention in delaying the flush of water includes two pumps at different levels and one connector in which a magnet is enclosed. All of these pumps and connector contain viscous oil in them. By the weight of somebody upon the seating circle, one pump is activated. Consequently, the oil starts to take the movement in the connector and so does the magent. The magnet attracts the lever and a lever controls another pump. Finally, this pump enables the conduit in water tank to be opened and permitting the water to be flushed into the basin.

Regarding to the water tank, there are two implementations in this invention. The first one comprises a water entrance installed near the top of water tank, a buoyant ball utilized to cork an air hole. So that the filling of water in the tank means compressing the air. The second one is a closed tank in which the water entrance is installed near the bottom. The air enclosed in the tank is compressed when filling the tank with water.

The compressed air in water tank presses the water to flush into the basic with stronger force as soon as the conduit is opened by the delaying drainage mechanism.

DETAILED DESCRIPTION

Figure 1:
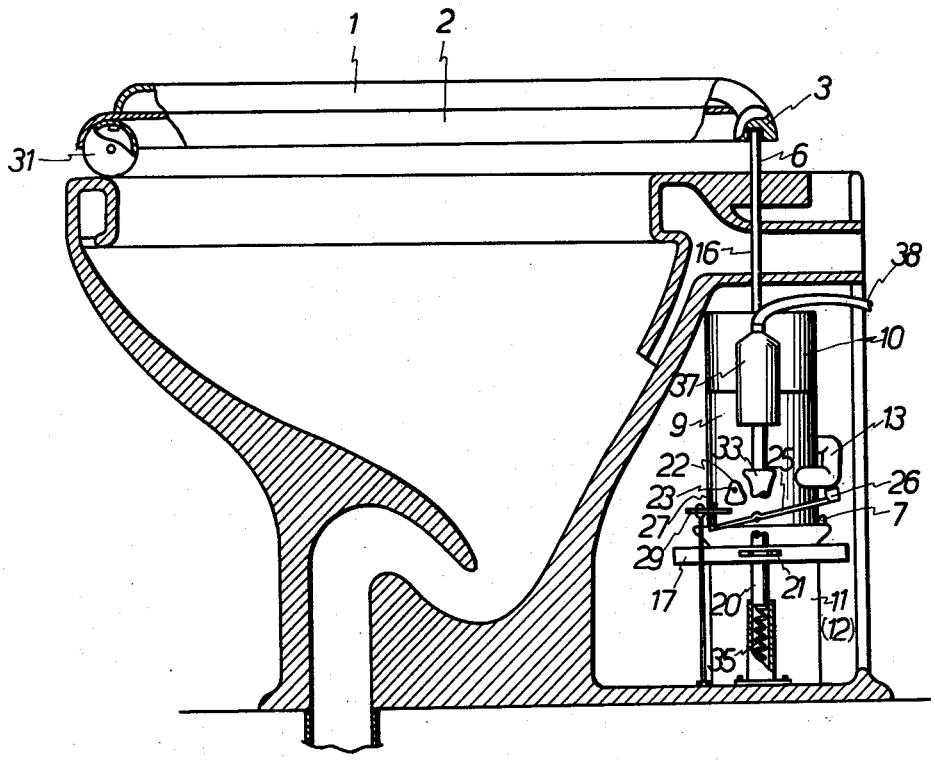
FIG. 1 depicts the side view of the detailed structure of delaying drainage mechanism of this invention.
Figure 2:
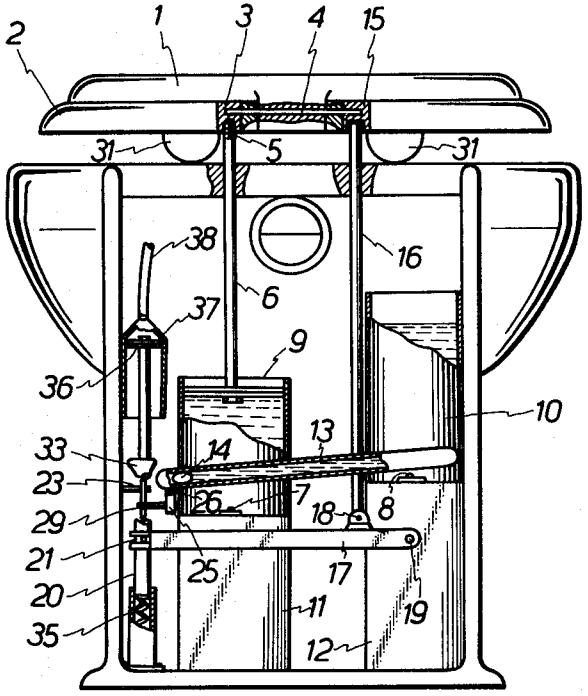
FIG. 2 depicts the rear view of the detailed structure of delaying drainage mechanism of this invention.

With reference to the FIG. 1 and 2, the cover 1 and seating circle 2 of the flush-toilet are connected together with the active seat 3 by the pivot bar 4. By the thread 5, the piston rod 6 is screwed with the active seat 3 also. The screw 7 and screw 8 fix respectively the low pump 9 and high pump 10 at their bottom 11 and 12. The connector 13 between the low pump 9 and high pump 10 is at an inclination. One magnet 14 is enclosed in the connector 13. Other end of pivot bar 4 is installed in the active seat 15 in which a crank 16 is seated also. The bottom end of crank 16 is associated with driving rod 17 by the pivot 18. The driving rod 17 takes the fulcrum 19 as the center to move upward or downward, so does the driven rod 20 which is associated together with driving rod 17 by the slot 21.

The button 22 is pivoted by the pin 23 to the wall, it can revolve around the pin 23, but it is pending down vertically. Now with reference to the FIG. 4, a pin 24 is utilized to associate with the magnet lever 25. One end of magnet lever 25 has a magnet 26, the other end has a hook 27 to connect with the sleeve 28 of "L" lever 29. "L" lever 29 takes pin 30 as the fulcrum.

Figure 3:
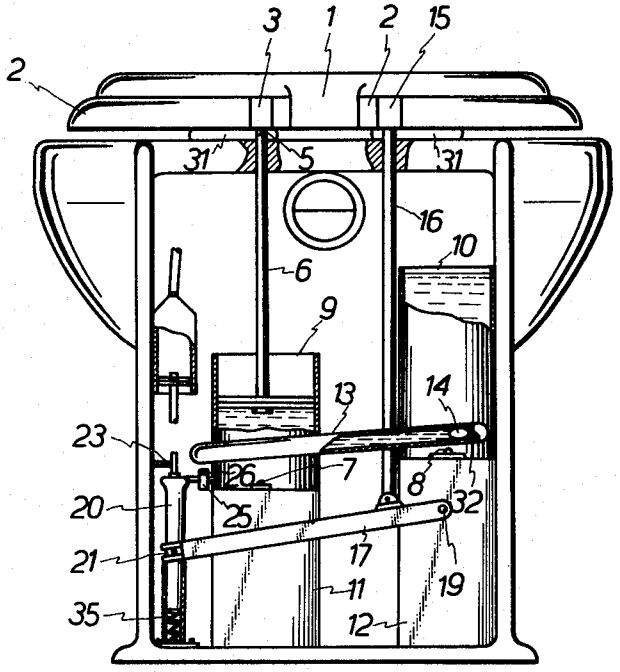
FIG. 3 illustrates the mechanism function of various parts when the flush-toilet is under the weight of somebody.
Figure 4:
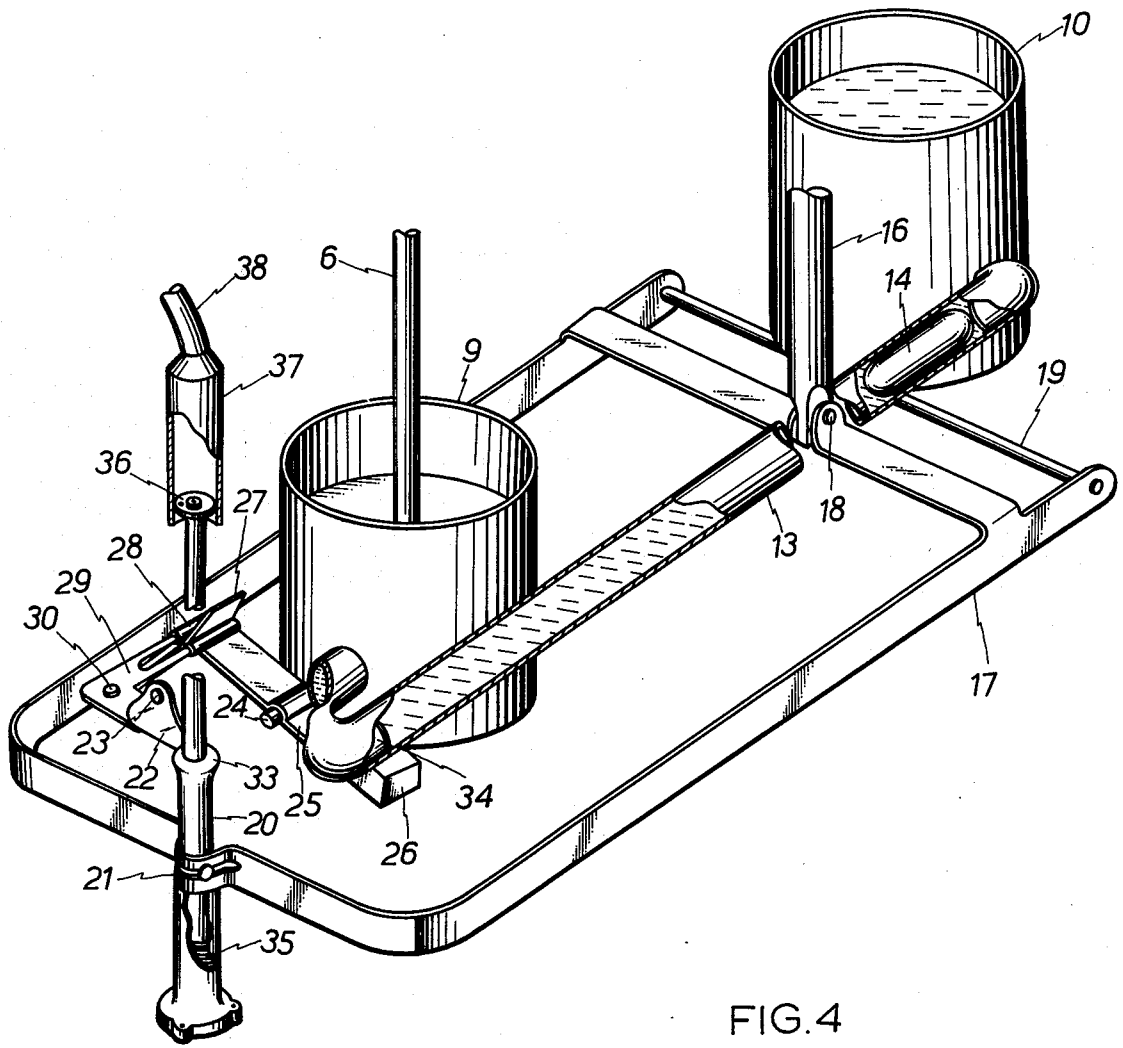
FIG. 4 depicts the detailed structure of delaying drainage mechanism.

Now with reference to the FIG. 3, as soon as the seating circle 2 is pressed down by the weight of somebody, the spring ball 31, the piston rod 6 and the crank 16 are pressed down also. So that the viscous oil in the low pump 9 flows through the connector 13 into the high pump 10, the magnet 14 is driven up to the upper ring 32. The diameter of magnet 14 is smaller than the interior of connector 13. The seating of magnet 14 on the upper ring 32 does not block the flow of viscous oil into the high pump 10. The inclination of connector 13 is decided by the viscosity of oil and the weight of magnet 14 so that the magnet 14 does not move down in the connector 13 even when the oil no longer flows into the high pump 10. Meanwhile, the crank 16 activates the driving rod 17 downward, and so does the driven rod 20. Then the protuberance 33 of driven rod 20 is resisted against by the button 22 at the below, as shown in FIG. 4.

When the weight upon the seating circle 2 is removed, the viscous oil in the high pump 10 will flow through the connector 13 return back to low pump 9, so that the magnet 14 is drawn back slowly also. It is obvious that the movement of the viscous oil is very slow, and so is the magnet 14. After a short time, the magnet 14 comes to the position of lower ring 34 to attract the magnet 26. so the magnet lever 25 is activated to move the hook 27 downward. By the association of sleeve 28, the "L" lever 29 is triggered forward to release the button 22. The balance of button 22 is lost. The spring 35 pushes the driven rod 20 upward swiftly. The piston 36 compresses the air in the cylinder 37 out to get through the pipe 38 to enter the water tank 39.

Figure 6:
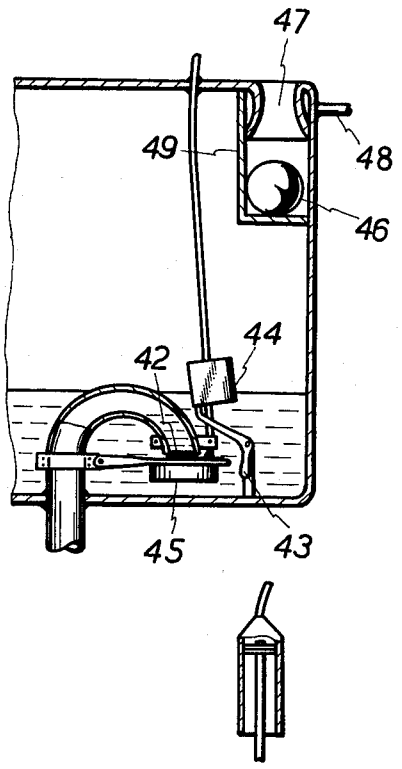
FIG. 6 illustrates the situation at which the water level in the tank is filled and the stopper closes the water conduit.
Figure 5:
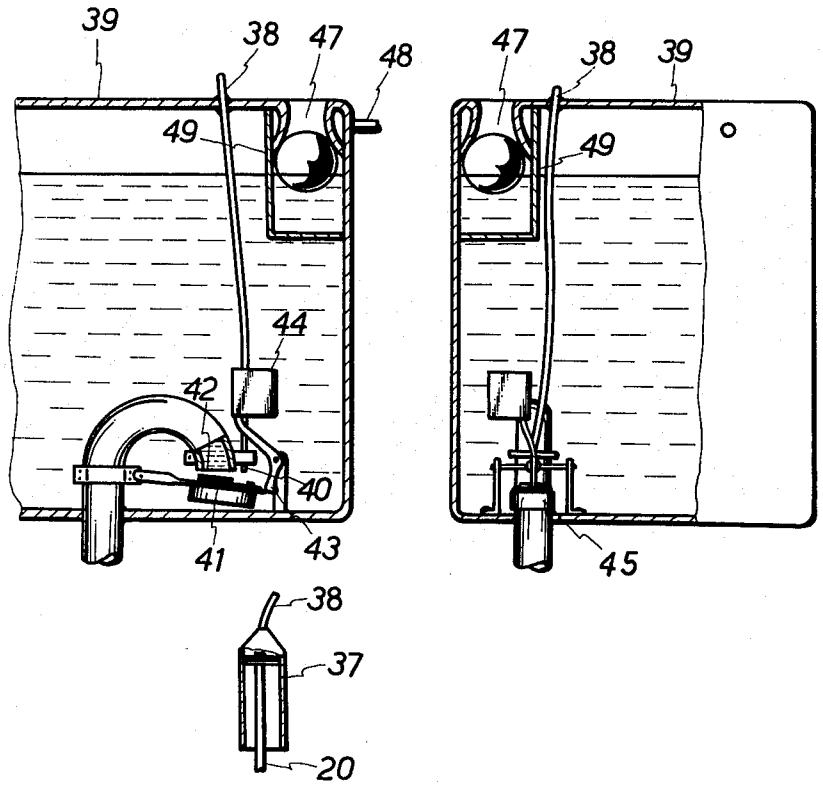
FIG. 5 illustrates the situation at which the jetted air from the pipe opens the stopper of water conduit.

Now with reference to the FIG. 5 and FIG. 6, the air jetted from the nozzle 40 of pipe 38 to push the stopper 41 downward to open the conduit 42. The water flows through the conduit 42 into the basin of flush-toilet. When the stopper 41 moves downward, its front protuberance pushes the controlling rod 43, which is associated with floater 44, away. So that even if the air does not jet from the pipe 38 continuously, the controlling rod 43 will resist against the stopper 41 to prevent the conduit 42 being closed.

As the water level in tank 39 falls, the floater 44 will decrease its position also. The controlling rod 43 separates from the front protuberance of stopper 41. Below the stopper 41, a buoyancy member 45 will lift the stopper 41 up to close the conduit 42 as soon as the controlling rod 43 separates from the stopper 41.

In the water tank 39, there is a buoyant ball 46. This buoyant ball 46 will close the air hole 47 while the water tank 39 is filled. But as soon as the water in the tank 39 is falling, the buoyant ball 46 separates from the air hole 47 to permit air to enter the water tank 39. Consequently the drainage of water from tank 39 is facilitated.

From the entrance 48, the water flows into the tank 39. Even if the buoyant ball 46 has closed the air hole 47 already, water can continuously flow into the tank 39 until the air pressure in the tank 39 equals to that in the entrance 48. So the compressed air contained in the tank 39 will push strongly the water to flush into the basin of flush-toilet as soon as the stopper 41 is opened. Meanwhile, the separating net 49 is utilized in the tank to hold the buoyant ball 46.

Figure 7:
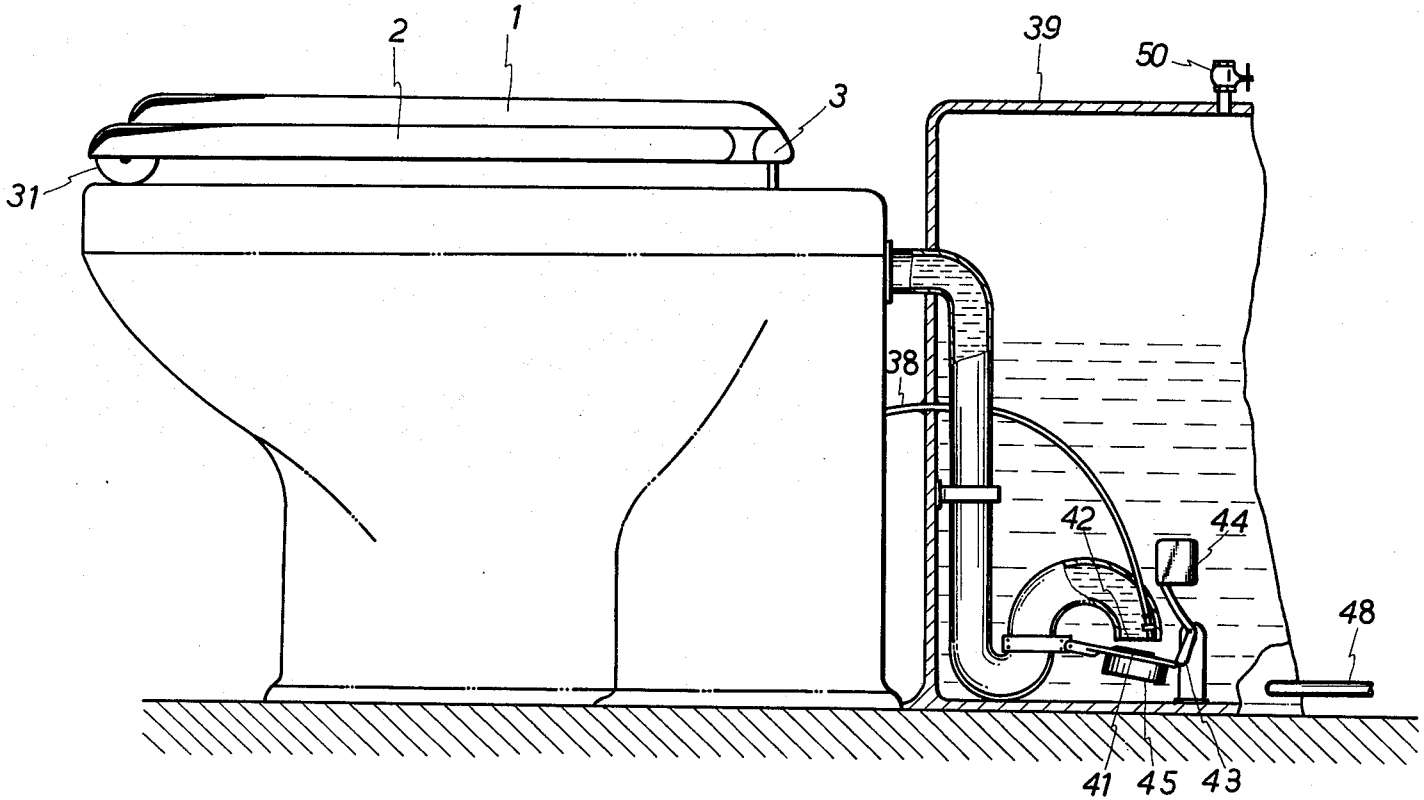
FIG. 7 depicts the structure relationship between the flush-toilet and the water tank, the compressed air filled in the water tank forcing the water into the basin.

Another implementation of water tank is illustrated in FIG. 7. The entrance 48 is installed at the bottom of water tank 39. The nozzle 40 of pipe 38 is installed inside the conduit 42. A pressure valve 50 is utilized at the top of tank 39. At the time of installing the invention, some quantity of air will be enclosed in this tank. When water enters into this tank from the entrance 48, the air will be compressed. The compressed air will improve the water strength in entering into the conduit 42. The air jetted from the pipe 38 will be pushed into the conduit 42 also and flows out into the basin of flush-toilet. Thus the quantity of air in the water tank 39 will be kept in constant.

As shown in FIG. 4, there is a valve 51 is utilized at the piston 36. This valve 51 is opened as the driven rod 20 is pushed downward. Thus pulling the piston 36 does not suck the water in tank 39 into the pipe 38.

I claim:

1. An automatic flushing system for a toilet bowl having a liquid inlet, a liquid outlet and a liquid reservoir for supplying flushing liquid to the bowl through said inlet, said system comprising a toilet seat atop said bowl, resilient compression means interposed between said seat and said bowl, a first viscous-liquid cylinder, a plunger in said first cylinder, a rod connecting said plunger to said seat whereby pressure applied to said seat to compress said resilient compression means also effects depression of said plunger in said first cylinder and release of said applied pressure on said seat causes the resilient compression means to expand thereby raising said seat and also raising said plunger in said first cylinder, a second viscous-liquid cylinder, a liquid flow pipe connecting said first and second cylinders, said pipe being inclined upwardly from said first cylinder to said second cylinder, a free-floating magnet within said pipe, said magnet having limited free travel within said pipe between lower and upper positions, said magnet being urged towards said upper position by liquid flowing from said first to said second cylinder in response to said application of pressure on said seat, said magnet being urged to said lower position by liquid flowing from said second to said first cylinder in response to the release of said pressure from said seat, control means for releasing flushing liquid from said reservoir to flow into said bowl, magnetic triggering means for actuating said control means in response to said magnet attaining said lower position in said pipe and mechanical cocking means operative in response to said pressure applied to the seat for setting said triggering means to respond to said magnet when said magnet attains said lower position.

2. The system of claim 1 wherein said control means for releasing flushing liquid from said cylinder comprises a compressed air-operated release valve in said reservoir, a compressed air generating device for operating said valve including a compression cylinder and piston and spring means operating on said piston, said spring means being released by said triggering means to operate the piston to produce compressed air to acuate said release valve.

3. The system of claim 2 wherein said triggering means includes a pair of cooperating pivoted bell crank levers and a release cam operatively interposed between one of said levers and said piston, the other of said levers being attracted by said magnet when said magnet attains said lower position to swing said one of said levers to a cam-freeing position allowing said spring means to release said piston for the production of compressed air to operate said release valve.

4. The system of claim 3, wherein said mechanical cocking means includes a lever arm pivoted to said piston and a push rod connected between said lever arm and said seat to cause the lever arm to move said piston to compress said spring means when said pressure is applied to said seat.

* * * * *